US010517371B2

(12) United States Patent
Miller

(10) Patent No.: US 10,517,371 B2
(45) Date of Patent: Dec. 31, 2019

(54) CURING APPLICATOR

(71) Applicant: L'Oreal, Paris, FL (US)

(72) Inventor: Zane Bowman Allen Miller, Seattle, WA (US)

(73) Assignee: L'Oreal, Paris (FR)

( * ) Notice: Subject to any disclaimer, the term of this patent is extended or adjusted under 35 U.S.C. 154(b) by 673 days.

(21) Appl. No.: 15/182,364

(22) Filed: Jun. 14, 2016

(65) Prior Publication Data

US 2017/0354235 A1 Dec. 14, 2017

(51) Int. Cl.

| | |
|---|---|
| ***A45D 29/18*** | (2006.01) |
| ***A45D 34/04*** | (2006.01) |
| ***A45D 29/00*** | (2006.01) |
| *A45D 34/00* | (2006.01) |

(52) U.S. Cl.

CPC ..... *A45D 34/045* (2013.01); *A45D 29/00* (2013.01); *A45D 2034/002* (2013.01)

(58) Field of Classification Search

CPC ..... A45D 34/045; A45D 29/00; A45D 33/32; A45D 2034/002; A45D 2200/205; A46B 9/021; A46B 15/00; A46B 15/0036

USPC ..... 132/73.5, 74.5, 75, 75.8

See application file for complete search history.

(56) References Cited

U.S. PATENT DOCUMENTS 8,403,008 B2 * 3/2013 Bouix ..... A45D 34/04 141/23
2009/0320316 A1 12/2009 Zakai
2015/0289627 A1 * 10/2015 Chang ..... A45D 29/00 34/275
2016/0220006 A1 * 8/2016 Le ..... A45D 29/18
2017/0215550 A1 * 8/2017 Walia ..... B41J 3/4073

FOREIGN PATENT DOCUMENTS

| | | | |
|---|---|---|---|
| CN | 204218236 | U | 3/2015 |
| DE | 20 2012 008396 | U1 | 12/2012 |
| DE | 20 2012 008 396 | U1 | 1/2013 |
| DE | 10 2012 018 384 | A1 | 3/2014 |
| EP | 2 823 894 | A1 | 1/2015 |
| JP | 2005-118207 | A | 5/2005 |

OTHER PUBLICATIONS

International Search Report and Written Opinion dated Jul. 21, 2017, issued in corresponding International Application No. PCT/US2017/034841, filed May 26, 2017, 12 pages.

* cited by examiner

*Primary Examiner* — Nicholas D Lucchesi

(74) *Attorney, Agent, or Firm* — Christensen O'Connor Johnson Kindness PLLC

(57) ABSTRACT

A curing applicator for curing a curable formulation as it is applied to a surface includes an applicator assembly extending from a base assembly. The applicator assembly is configured to apply the curable formulation to the surface. The curing applicator further includes a curing assembly configured to deliver a curing stimulus. The curing assembly extends from the base assembly and is positioned to follow the applicator as it applies the curable formulation to the surface.

13 Claims, 10 Drawing Sheets

CURING APPLICATOR

SUMMARY

In an embodiment, a curing applicator for curing a curable formulation as it is applied to a surface includes an applicator assembly extending from a base assembly. The applicator assembly is configured to apply the curable formulation to the surface. The curing applicator further includes a curing assembly configured to deliver a curing stimulus. The curing assembly extends from the base assembly and is positioned to follow the applicator as it applies the curable formulation to the surface.

In an embodiment, a curing applicator for curing a curable formulation as it is applied to a surface, wherein the curable formulation contained in a container, includes an applicator assembly extending from a base assembly that is removably securable to the container. The applicator assembly is disposable within the container when the base assembly is secured to the container, and the applicator assembly is configured to apply the curable formulation to the surface. A curing assembly is configured to deliver a curing stimulus, wherein the curing assembly extends from the base assembly and positioned to follow the applicator as it applies the curable formulation to the surface.

In an embodiment, a method of curing a curable formulation as it is applied to a surface includes positioning a curing assembly relative to an applicator assembly such that the curing assembly follows the applicator assembly as it applies the curable formulation to the surface, and applying the curable formulation to the surface with the applicator assembly.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this invention will become more readily appreciated by reference to the following detailed description, when taken in conjunction with the accompanying drawings, wherein.

DETAILED DESCRIPTION

Conventional nail polishes consist of solutions having solvents and other components, wherein the nail polish hardens after application by evaporation of the solvents. Improved "gel" nail polishes will cure much faster with the use of ultra violet (UV) lamps or light emitting diode (LED) lamps, depending on the gel formulation. The lamp typically includes an opening sized to receive substantially all the fingers of a user's hand, with the UV or LED bulbs on the top interior of the lamp. After applying one or more layers of nail polish to the user's fingers, the user inserts his or her hand into the lamp to allow the polish to cure. This step-by step process can take considerable time.

A specific type of UV or LED lamp must also often be used with a certain nail polish formulation. For instance, certain gel polishes will only cure under an LED lamp, and certain gel polishes will only cure under a UV lamp. Moreover, some polishes cure faster with stronger lamps, whereas other polishes only need a lower wattage lamp.

Thus, there is a need for an apparatus for curing a curable formulation, such as nail polish, that shortens the process, wherein the apparatus is individual and specific to the curable formulation to ensure that the proper curing technology or curing stimulus is used.

The above-described curing lamps, which receive the entire user's hand or at least a portion of the user's hand (such as all fingers except the thumb) also expose an unnecessary portion of the user's hand to potentially damaging light. More specifically, the user's hand and/or fingers could be damaged by repeated exposure to UV light or other types of light. Thus, there is an additional need for an apparatus for curing a curable formulation that minimizes unnecessary exposure of the user's skin to damaging light.

In an aspect, the present disclosure is directed to, among other things, to a curing applicator for curing a curable formulation, such as nail polish or another curable polymer, as it is applied to a desired surface or location, such as a user's fingernail. In an embodiment, "curable formulation" includes nail polish, varnish, lacquer, and the like, or any other type of material curable by a stimulus, such as a light-curable coating, material, polymer, composition, formulation, etc.

Moreover, the curing applicator uses a suitable "curing assembly" having a curing stimulus assembly with a curing stimulus capable of curing an intended curable formulation. For instance, the curing stimulus assembly may be defined by a light assembly having UV light or LEDs that are suitable for curing the curable formulation, such as nail polish. However, any other suitable curing stimulus assembly capable of curing the intended curable formulation may instead be used. Thus, the description and illustrations provided herein should not be seen as limiting the scope of the claimed subject matter.

Figure 1:
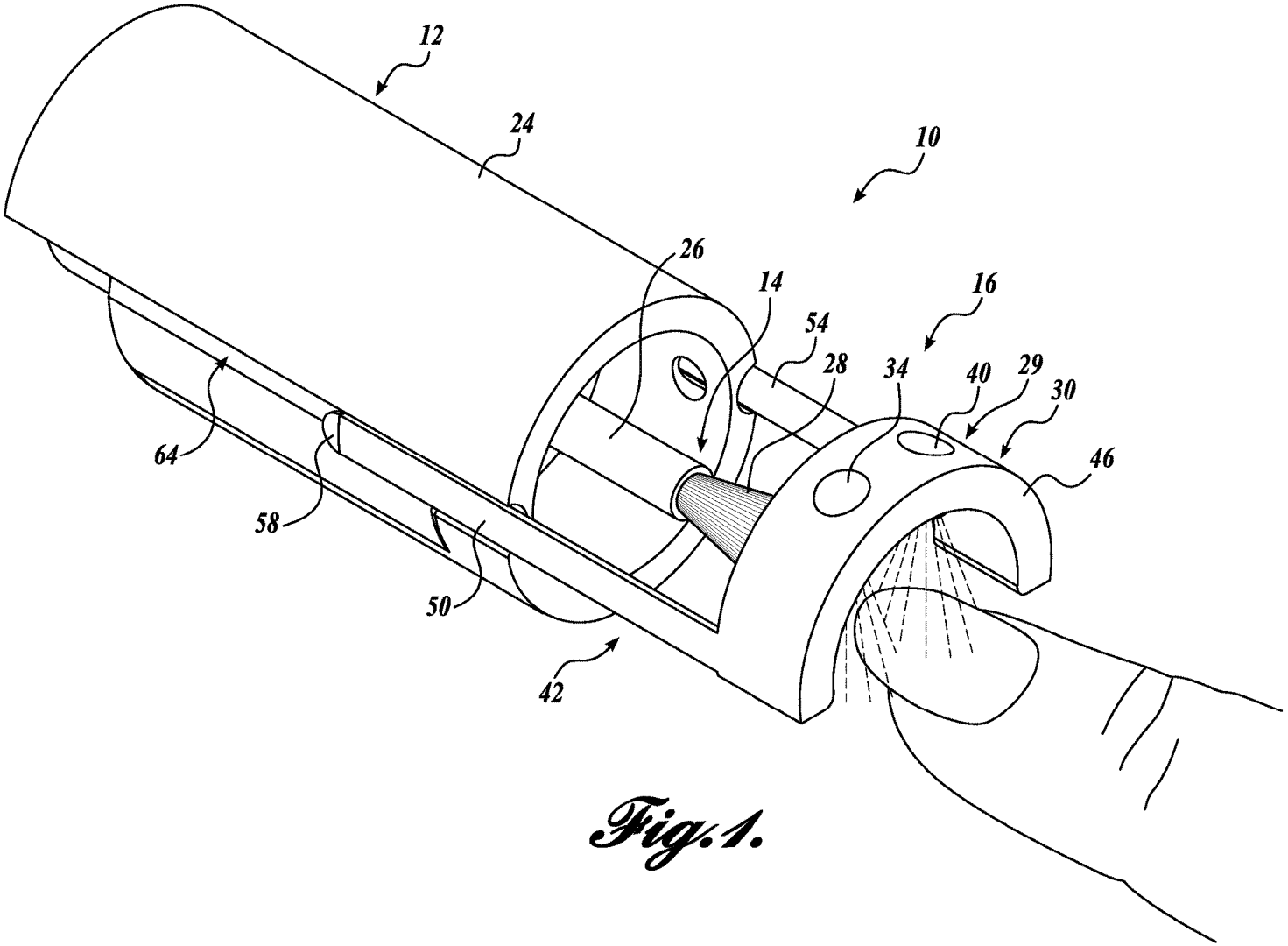
FIG. 1 is a top isometric view of a first exemplary embodiment of a curing applicator formed in accordance with the present disclosure, wherein the curing applicator is shown in a first position for curing polish on a fingernail.

Referring to FIG. 1, a first exemplary embodiment of a curing applicator 10 will now be described in detail. The curing applicator 10 generally includes a base assembly 12, an applicator assembly 14 extending from the base assembly 12 and configured to apply a curable formulation to a surface, and a curing assembly 16 positionable relative to the applicator assembly 14 for curing the curable formulation as it is applied to the surface.

In the depicted embodiment, the base assembly 12 and applicator assembly 14 are generally designed to replace a cap and applicator brush of a nail polish bottle or other similar container (not shown). In that regard, the base assembly 12 is comprised of a substantially cylindrical cap portion 24 having an internal cavity with internal threads (not shown) for threadably engaging a threaded upper throat of a container, such as a nail polish bottle.

The applicator assembly 14 is comprised of an elongated stem 26 extending from an interior of the cap portion 24, with an applicator portion or tip 28, such as a brush, defined on the distal end of the stem 26. When the cap portion 24 is coupled to the nail polish bottle, for instance, the stem 26 and applicator tip 28 extend within the bottle such that the tip 28 may withdraw curable formulation contained within the bottle. It should be appreciated that any suitable cap and applicator tip may instead be used for the intended container and/or curable formulation. For instance, in some applications, a cap portion may not be necessary, and the base assembly 12 may instead be defined by a proximal end of the elongated stem 26 or another portion of the applicator assembly 14. As another example, the applicator assembly 14 may instead be comprised of a sponge or other type of material for applying the curable formulation to a surface.

The curing assembly 16 will now be described in detail. As noted above, the curing assembly 16 includes a curing stimulus assembly 29 configured to cure the curable formulation as it is applied to a surface by the applicator tip 28. In an embodiment, the curing stimulus assembly 29 is a light assembly 30 suitable for curing the curable formulation. In an embodiment, the light assembly 30 includes one or more energy emitters configured to deliver an electromagnetic energy stimulus. Non-limiting examples of energy emitters include arc flashlamps, radiation emitters, ion emitters, photon emitters, electron emitters, gamma emitters, thermal energy emitters, and the like. Further non-limiting examples of energy emitters include continuous wave bulbs, fiber lasers, lasers, incandescent emitters, laser diodes, lasers, light-emitting diodes, micro-cavity light-emitting diodes, micro-cavity resonators, organic light-emitting diodes, polymer light-emitting diodes, quantum dots, transducers, ultrafast lasers, and the like.

In an embodiment, the light assembly 30 may be comprised of any suitable light-curing technology, such as for instance, light-emitting diodes (LEDs) (e.g., organic light-emitting diodes, polymer light-emitting diodes, polymer phosphorescent light-emitting diodes, microcavity light-emitting diodes, high-efficiency UV light-emitting diodes, and the like), ultraviolet (UV) LEDS, or other suitable LEDs, or any other suitable UV light source or other light-curing technology now known or later developed, and any combination thereof.

As a specific example, the light assembly 30 may be comprised of a UV light source that cures a curable formulation at 403 nm with a power of 36-46 mW/cm2. It can be appreciated that cure times may vary based on the formulation, volume, etc., of the curable formulation. For instance, certain UV curing polymers cure at shorter wavelengths, such as 365 nm.

In the depicted embodiment, the light assembly 30 includes first and second UV LEDs 34 and 40 secured within a portion of a light-positioning assembly 42, although fewer or more LEDs may instead be used. For instance, the light assembly 30 may instead include an array of LEDs spanning across a portion of the light-positioning assembly 42.

In an embodiment, the curing applicator 10 includes a power source. The power source is operably coupled to one or more components, modules, circuitry, sensors, and the like of the curing applicator 10. Non-limiting examples of power sources include one or more button cells, chemical battery cells, a fuel cell, secondary cells, lithium ion cells, micro-electric patches, nickel metal hydride cells, silver-zinc cells, capacitors, super-capacitors, thin film secondary cells, ultra-capacitors, zinc-air cells, and the like. In an embodiment, the curing applicator 10 is inductively coupled to a power source via one or more antennas. In an embodiment, the curing applicator 10 is wirelessly coupled to a power source via one or more antennas. In an embodiment, the power source is electromagnetically, magnetically, acoustically, optically, inductively, electrically, or capacitively coupled to one or more components, modules, circuitry, sensors, and the like of the curing applicator 10.

In an embodiment, the curing stimulus assembly 29 is powered by a suitable power source, such as a battery, located within the interior of the cap portion 24 (not shown). The battery may be replaceable through an opening in the cap portion 24, or instead rechargeable through an outlet in the cap portion 24. In the alternative, the curing stimulus assembly 29 may be powered solely through connection to a power source, such as by connecting to an electrical outlet. The power source is in electrical communication with the curing stimulus assembly 29 through a flexible electrical circuit, wire, etc., that may extend from the cap portion 24 to the curing stimulus assembly 29 through arms of the curing stimulus positioning assembly 42, which are later described. In the alternative, the power source (and any corresponding switch, outlet, etc.) and curing stimulus assembly 29 may both be disposed within the curing stimulus positioning assembly 42 such that no flexible circuit or wires are needed.

Figure 10:
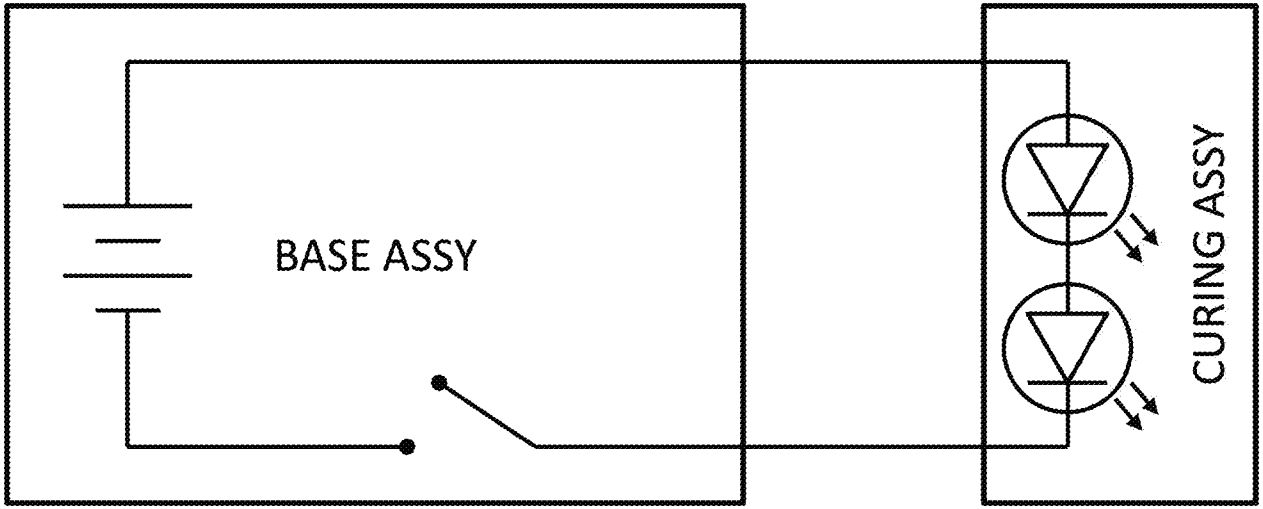
FIG. 10 is an exemplary block diagram of electrical architecture of a curing applicator formed in accordance with one of the exemplary embodiments of the present disclosure.

An illustrative block diagram showing an exemplary electrical architecture of the curing applicator 10 is shown in FIG. 10. The electrical connection between the power source and the curing stimulus assembly 29 may be activated by a switch on the cap portion 24, by wireless means, or simply by connecting the power source to an electrical outlet. As an alternative, the curing stimulus assembly 29 may be activated when the curing stimulus positioning assembly 42 is moved into a first, deployed position, as described below. As another alternative, the curing stimulus assembly 29 may be activated by a switch or an outside power source only when the curing stimulus positioning assembly 42 is in a first, deployed position. As yet another alternative, the applicator assembly 14 may include a sensor that activates the curing stimulus assembly 29 when the applicator tip 28 is being used to apply the curable formulation to a surface. It should be appreciated that the curing stimulus assembly 29 may instead be powered and activated by any suitable means.

The curing stimulus assembly 29 is disposed within a curing stimulus portion 46 of the curing stimulus positioning assembly 42. The curing stimulus portion 46 may be generally curved, or semi-cylindrical in shape, to substantially correspond to the contour of a user's fingernail or other desired surface. In that regard, a portion of the curing stimulus assembly 29 is positioned within the curing stimulus portion 46 to direct the curing stimulus onto a surface.

For example, in the depicted embodiment, the LEDs 34 and 40 of the light assembly 130 are positioned within the curved curing stimulus portion 46 to direct light downwardly and inwardly onto a fingernail positioned below. It should be appreciated that the curing stimulus portion 46 may instead be any other suitable contour, or the LEDs (or other curing stimulus) may instead be positioned within the curing stimulus portion 46 in another manner to direct light onto a desired surface. For instance, if LEDs are used, the LEDs may have specific exposure zones, such as cone-shaped zones ranging from 30-45 degrees (30-45°).

The curing stimulus portion 46 of the curing stimulus positioning assembly 42 extends from the cap portion 24 and is positioned above and outwardly from the applicator tip 28. More specifically, the curing stimulus portion 46 is positioned so that the curing stimulus assembly 29 may cure the curable formulation as it is applied to a surface by the applicator tip 28. For instance, as illustrated in FIG. 1, the light assembly 30 is positioned to cure nail polish as it is applied to a fingernail of a user. In this regard, the curing stimulus assembly 29 follows the application of the curable formulation as it is applied by the applicator tip 28.

Any suitable structure may be used to position the curing stimulus portion 46/curing stimulus assembly 29 in this curing position. In the embodiment depicted in FIG. 1, the curing stimulus positioning assembly 42 includes at least one arm, and preferably first and second arms 50 and 54 extending rearwardly from the curing stimulus portion 46. The first and second arms 50 and 54 extend along a side of the cap portion 24 and are pivotally connected to the cap portion 24 at their distal ends through suitable means. For instance, the first and second arms 50 and 54 may include a pointed protrusion (not labeled) at their ends that extends inwardly and is moveably receivable within an opening in the cap portion 24. The pivotal connection between the first and second arms 50 and 54 and the cap portion 24 defines first and second substantially aligned pivot points 58 and 60.

Figure 2A:
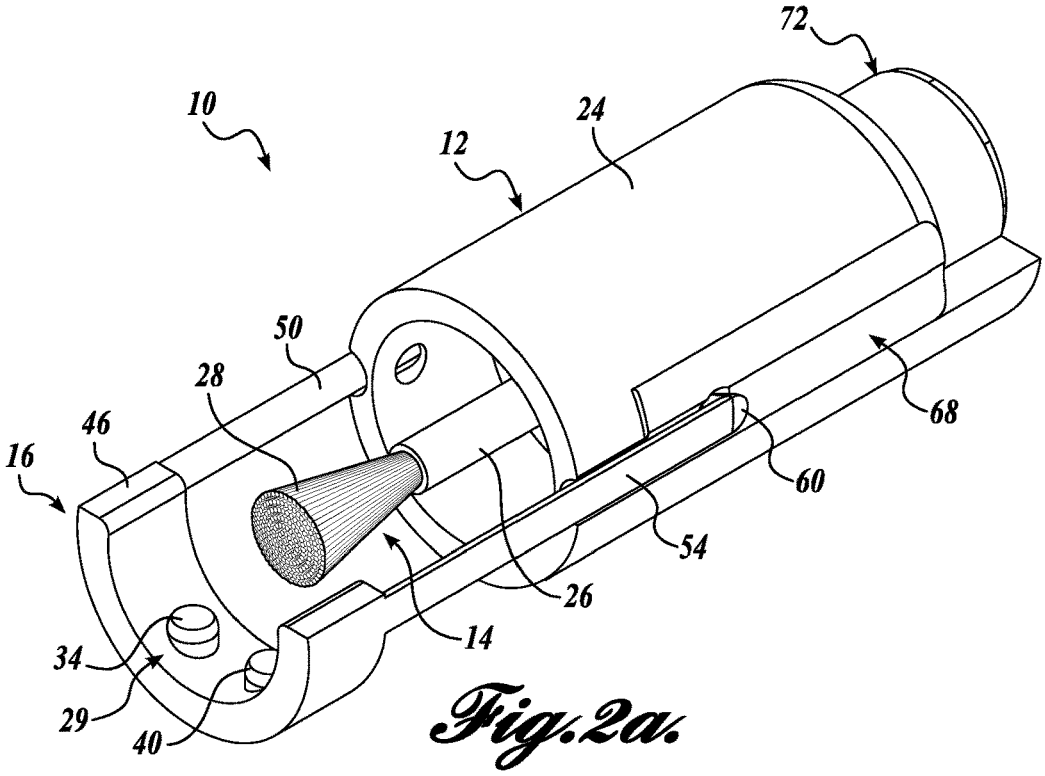
FIG. 2A is a bottom isometric view of the curing applicator FIG. 1, wherein the curing applicator is shown in the first position.
Figure 2B:
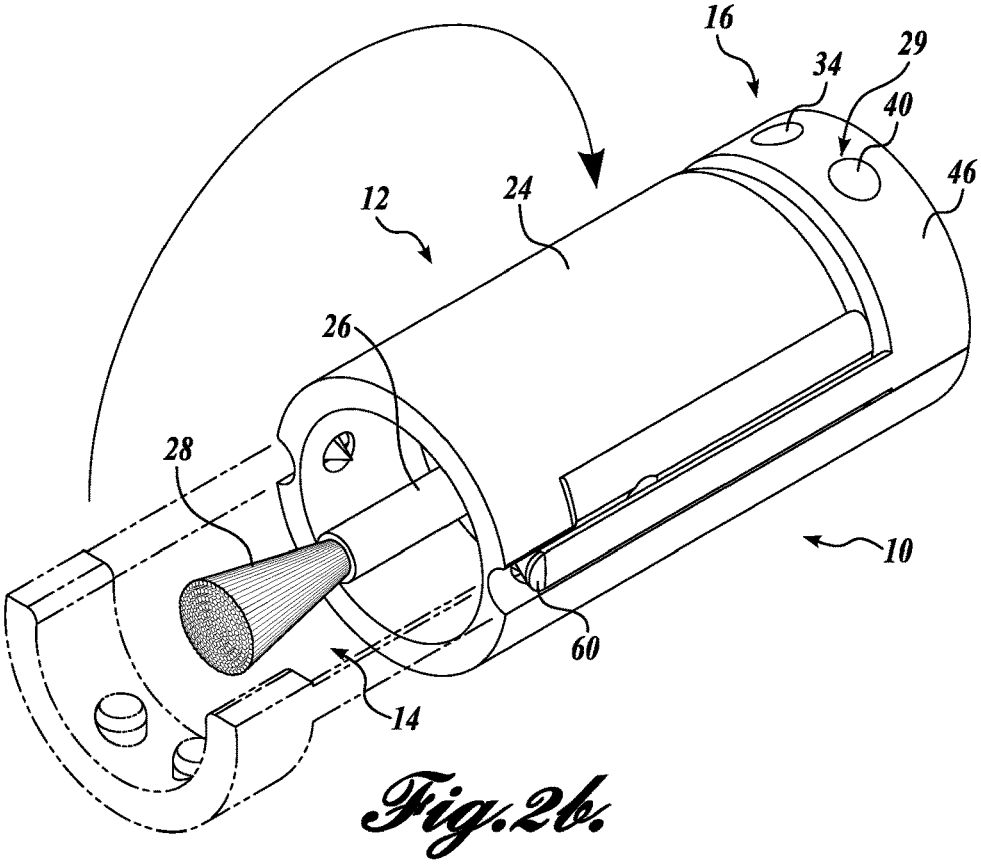
FIG. 2B is a bottom isometric view of the curing applicator of FIG. 1, wherein the curing applicator is shown in a second position.

Referring additionally to FIGS. 2A and 2B, the curing stimulus positioning assembly 42 is pivotal about the first and second pivot points 58 and 60 between a first, deployed position, as shown in FIG. 2A, and a second, stowed position, as shown in FIG. 2B. In first, deployed position, as shown in FIG. 2A, the first and second arms 50 and 54 extend from the cap portion 24 and they position the curing stimulus assembly 29 above (or below, as shown in FIG. 2A) and outwardly from the applicator tip 28. In this first, deployed position, the curing stimulus assembly 29 is positioned to cure the curable formulation as it is applied to a surface by the applicator tip 28. In the second, stowed position, as shown in FIG. 2B, the arms 50 and 54 and curing stimulus portion 46 are stowed along the side of the cap portion 24.

In that regard, the cap portion 24 may include first and second opposing arm cavities 64 and 68 extending along the cap portion 24 that are sized and positioned to receive and stow the first and second arms 50 and 54 when the curing stimulus positioning assembly 42 is in the second, stowed position. It should be appreciated that the arms 50 and 54 may be made from a suitably flexible material to accommodate any interference between the arms 50 and 54 and the cap portion 24 when the arms are moved between the deployed and the stowed position.

The cap portion 24 may further include a curing stimulus portion cavity 72 defined near its end that is sized and positioned to receive the curing stimulus portion 46 when the curing stimulus positioning assembly 42 is in the second, stowed position. The arms 50 and 54 and the curing stimulus portion 46 are receivable within their respective cavities 64 and 68 and 72 such that they are substantially flush with the cap portion 24 when stowed. As such, the cap portion 24, together with the curing stimulus positioning assembly 42 (arms 50 and 54 and the curing stimulus portion 46) defines a substantially cylindrical structure that is graspable by a user.

In that regard, in the second, stowed position, the curing applicator 10 may be secured to a nail polish bottle or other container, similar to a standard nail polish bottle cap or other container cap. With the curing applicator 10 securable to an individual container, such as a nail polish bottle, the curing applicator 10 is tied to a specific curable formulation, such as a specific nail polish, that requires a specific curing stimulus technology. Moreover, the curing applicator can be used to cure only the surface on which the curable formulation is applied (such as the fingernail), rather than exposing a larger surface (such as the user's hand) to the curing technology. Furthermore, the curing stimulus technology is used as the curable formulation is applied, saving the user time.

Figure 3:
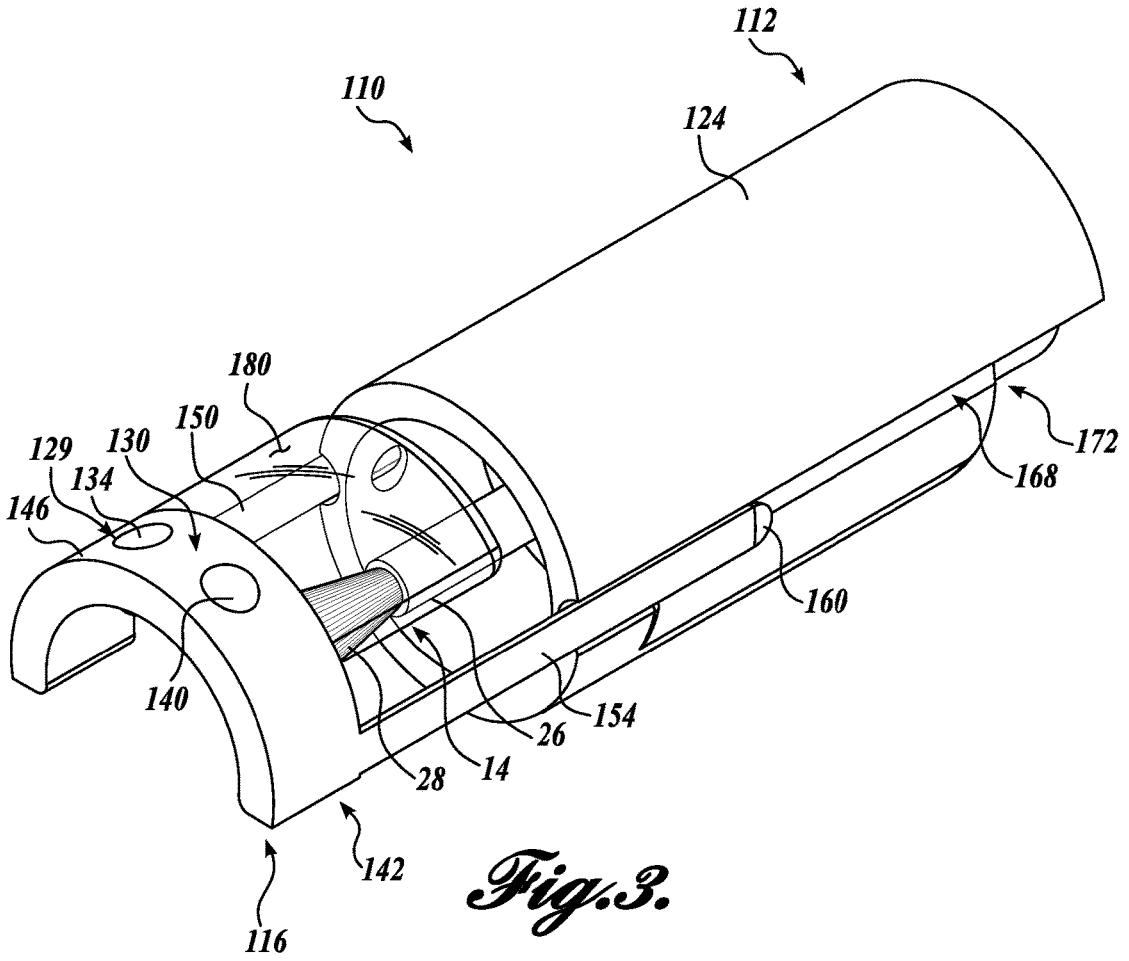
FIG. 3 is a top isometric view of a second exemplary embodiment of a curing applicator formed in accordance with the present disclosure, wherein the curing applicator is shown in a first position.

Referring to FIG. 3, a second exemplary embodiment of a curing applicator 110 is depicted. The curing applicator 110 is substantially similar to the curing applicator 10 described above with reference to FIGS. 1, 2A, and 2B. In that regard, for ease of reference, like reference numerals have been used to reference like parts except in the '100 series.

The curing applicator 110 includes a filtering element 180 secured to and extending from the curing stimulus portion 146. In one embodiment, the filtering element 180 is a shield configured to help filter or block damaging light or another curing stimulus coming from the curing stimulus assembly 129. The filtering element 180 substantially covers the gap between the curing stimulus portion 146 and the cap portion 124 when the curing stimulus positioning assembly 142 is in the first, deployed position, as shown in FIG. 3. More specifically, the filtering element 180 is positioned above the applicator tip 128 such that the curing stimulus, such as light, shines mostly down onto the surface on which the curable formulation is being applied. The filtering element 180 helps prevent the curing stimulus from deflecting upwardly onto, for instance, the thee of the user who is applying the curable formulation. The filtering element 180 may be made from any material suitable for shielding or at least partially blocking or filtering the curing stimulus from the curing stimulus assembly 129.

In the alternative or in addition thereto, the filtering element 180 may comprise a magnifying glass for enlarging the view of the surface on which the curable formulation in being applied. Particularly in the application of nail polish, small details must sometimes be painted onto the fingernail of a user. In such a situation, the integrated magnifying glass can be used to enlarge the painting surface for detailed application. In a second, stowed position (not shown), the filtering element 180 is receivable within a light shield cavity (not shown) adjacent to the light portion cavity (not shown) in the cap portion 124. In that regard, the light portion cavity may simply be extended or enlarged to also receive the filtering element 180 when the curing stimulus positioning assembly 142 is in the second, stowed position against the cap portion 124. It should be appreciated that the filtering element 180 or similar may be used with any of the other embodiments shown and described herein.

Figure 4A:
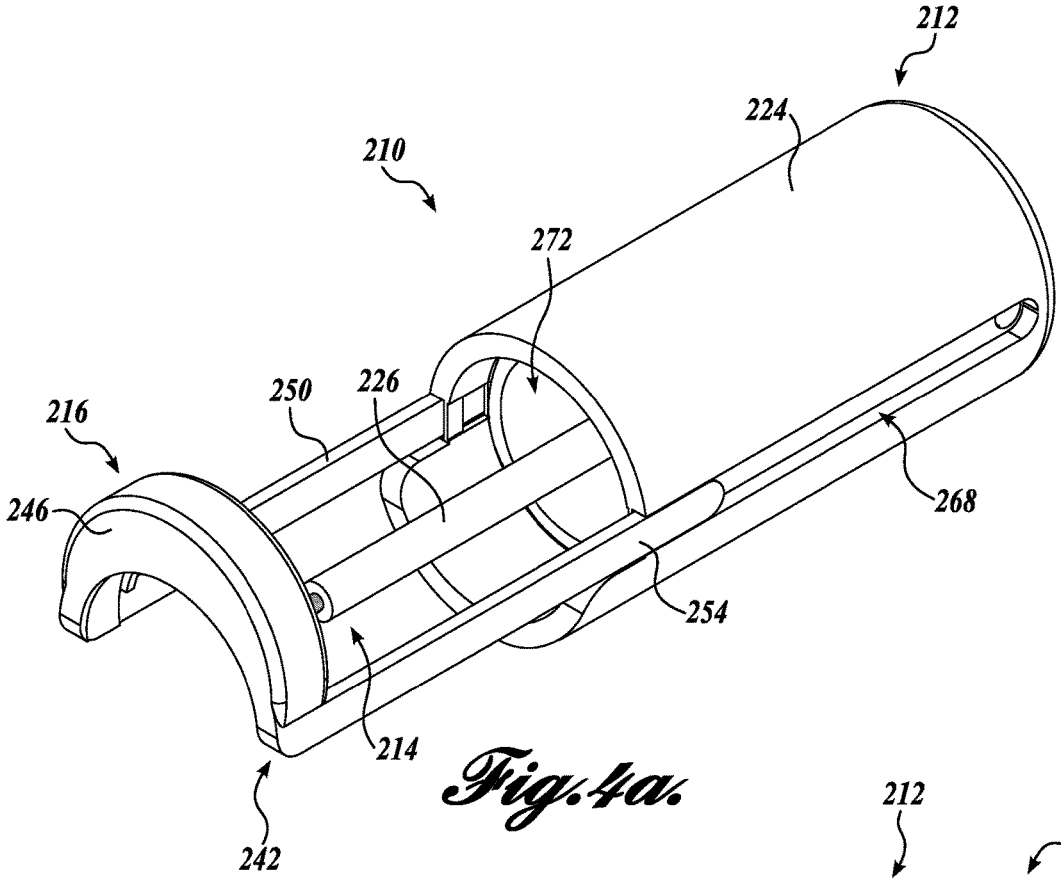
FIG. 4A is a top isometric view of a third exemplary embodiment of a curing applicator formed in accordance with the present disclosure, wherein the curing applicator is shown in a first position.
Figure 4B:
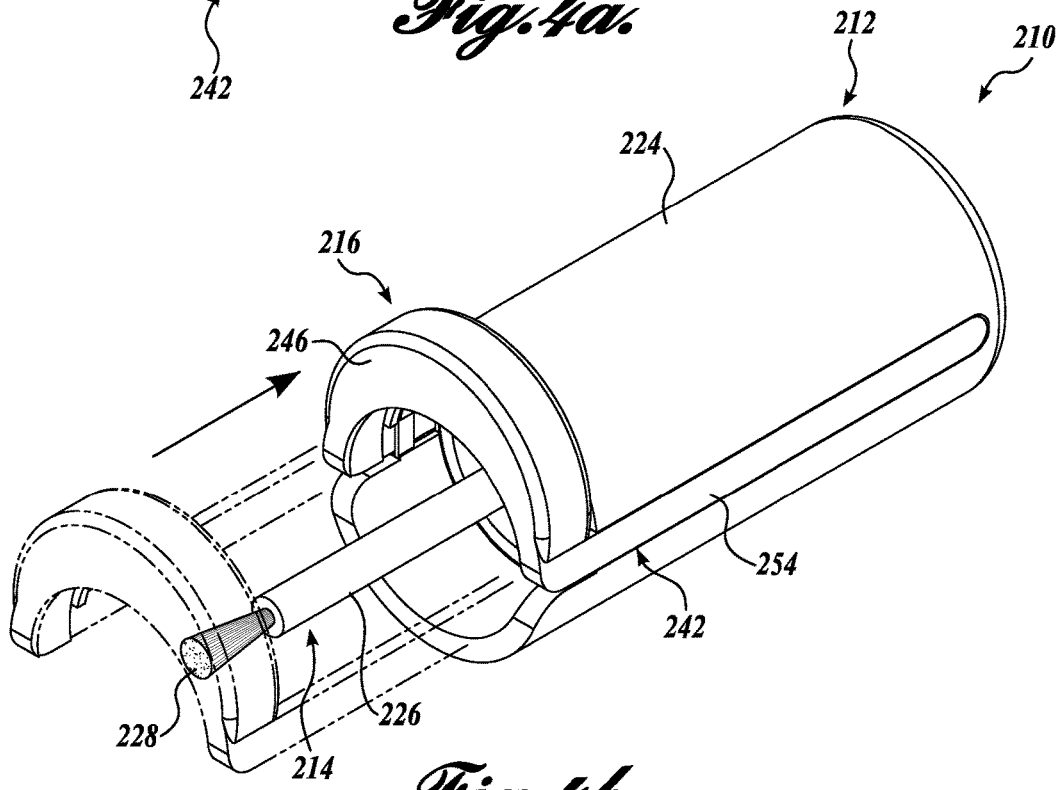
FIG. 4B is a top isometric view of the curing applicator of FIG. 4A, wherein the curing applicator is shown in a second position.
Figure 5:
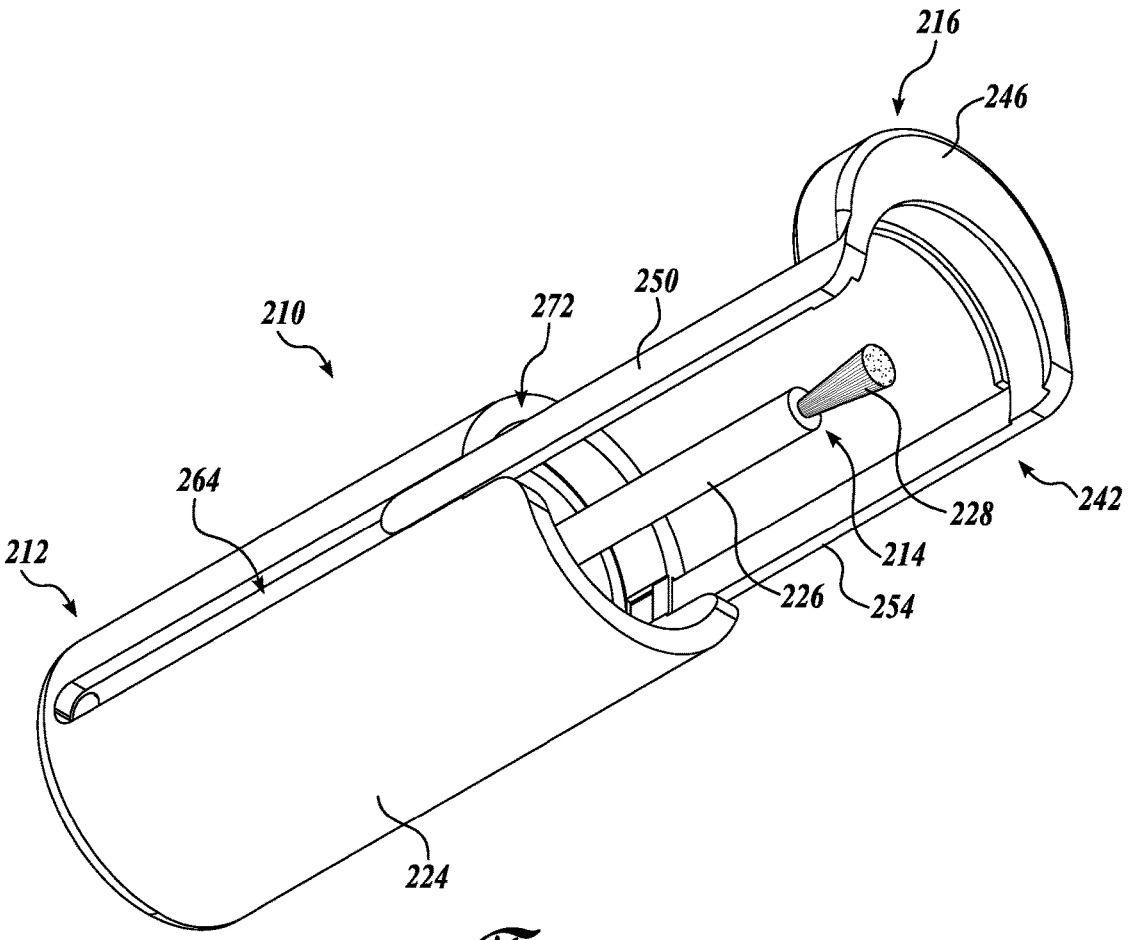
FIG. 5 is a bottom isometric view of the curing applicator of FIG. 4A, wherein the curing applicator is shown in the first position.

Referring to FIGS. 4A, 4B, and 5, a third exemplary embodiment of a curing applicator 210 is depicted. The curing applicator 210 is substantially similar to the curing applicator 10 described above with reference to FIGS. 1, 2A, and 2B. In that regard, for ease of reference, like reference numerals have been used to reference like parts except in the '200 series.

The curing applicator 210 similarly includes a curing stimulus positioning assembly 242 that is moveable between a first, deployed position, as shown in FIGS. 4A and 5, and a second, stowed position, as shown in FIG. 4B. However, in the curing applicator 210, the curing stimulus positioning assembly 242 is moveable between the first and second (deployed and stowed) positions by sliding the assembly linearly along the length of the cap portion 224.

In that regard, the curing stimulus positioning assembly 242 includes a curing stimulus portion 246 that houses a curing stimulus assembly (not shown), and first and second arms 250 and 254 extending from the curing stimulus portion 246 that are slidable within opposing grooves 264 and 268 defined along the side of the cap portion 224. Pin protrusions (not shown) or similar may be defined at the distal, interior end of each arm 250 and 254 that are selectively receivable within openings or notches (not labeled) defined at the ends of each groove 264 and 268.

To move the curing stimulus positioning assembly 242 into the first, deployed position, the first and second arms 250 and 254 are slid within the grooves 264 and 268 linearly away from the cap portion 224 until the pin protrusions are received within openings at the bottom end of the cap portion 224. Similarly, to move the curing stimulus positioning assembly 242 into the second, stowed position, the first and second arms 250 and 254 are slid within the grooves 264 and 268 linearly toward the cap portion 224 until the pin protrusions are received within openings at the top end of the cap portion 224. It should be appreciated that the arms 250 and 254 may be made from a suitably flexible material to allow the pin protrusions to move into and out of the openings in the cap portion 224 as the curing stimulus positioning assembly 242 is moved between the deployed and stowed positions.

The cap portion 224 includes a light portion cavity or recess 272 defined at a bottom of the cap portion 224 that is configured to receive the light portion 246 of the curing stimulus positioning assembly 242 when it is in the second, stowed position. In this manner, the curing stimulus positioning assembly 242 is stored compactly against the cap portion 224 when not in use such that the cap portion 224 may be secured on a container, such as a nail polish bottle, and such that the cap portion 224 is easily graspable by a user.

Figure 6:
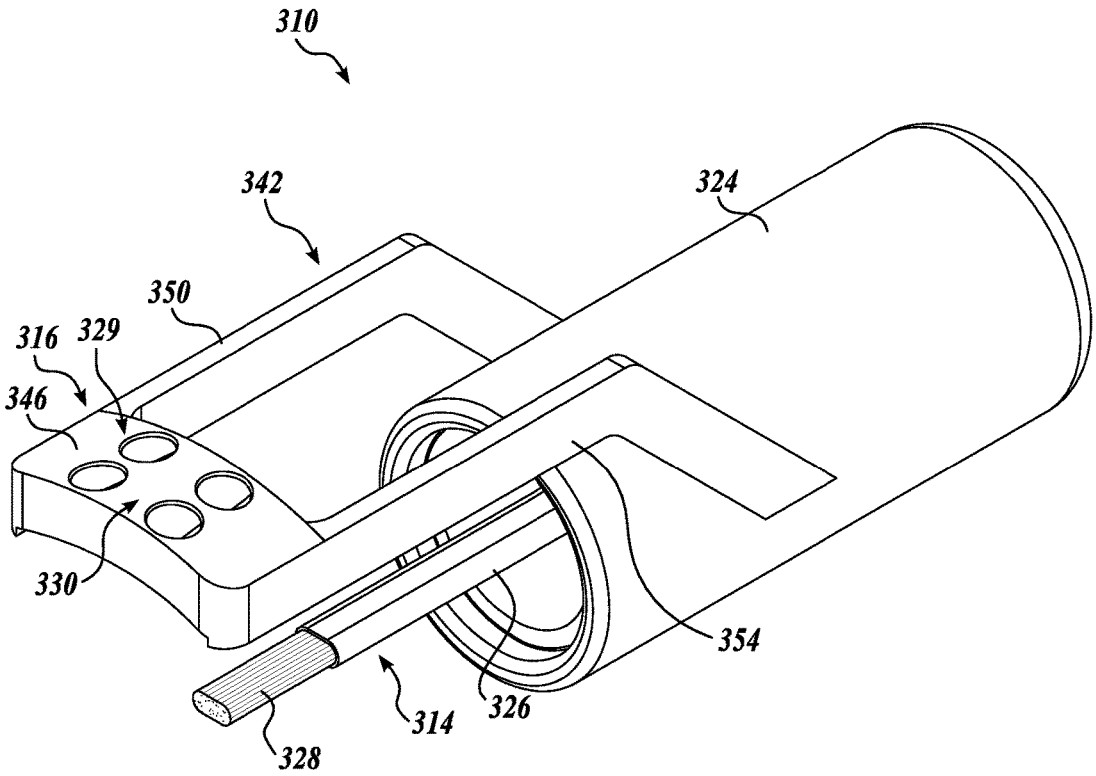
FIG. 6 is a top isometric view of a fourth exemplary embodiment of a curing applicator formed in accordance with the present disclosure.
Figure 7:
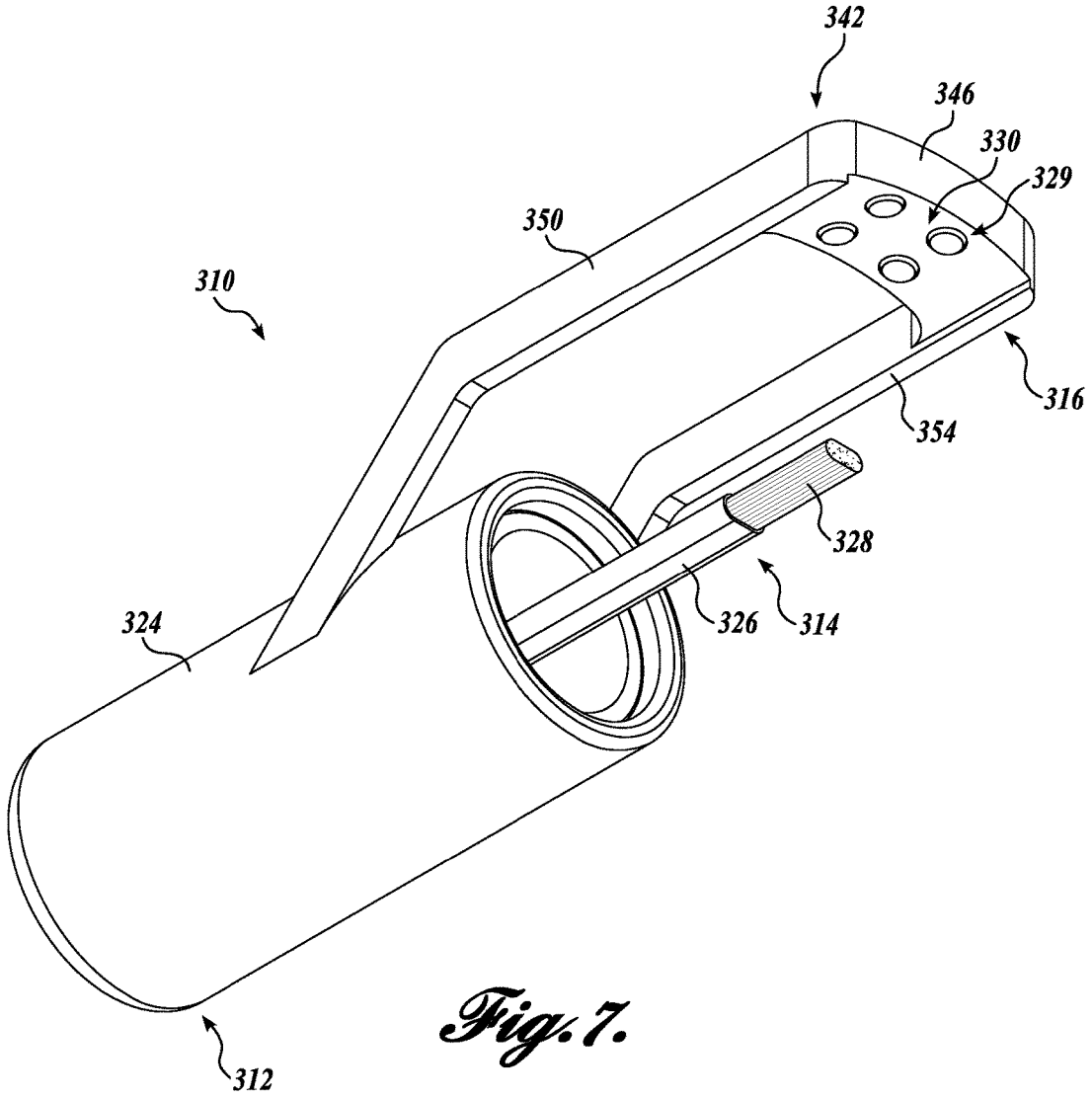
FIG. 7 is a bottom isometric view of the curing applicator of FIG. 6.

Referring to FIGS. 6 and 7, a fourth exemplary embodiment of a curing applicator 310 is depicted. The curing applicator 310 is substantially similar to the curing applicator 10 described above with reference to FIGS. 1, 2A, and 2B. In that regard, for ease of reference, like reference numerals have been used to reference like parts except in the '300 series.

In contrast to the curing applicators 10, 110, and 210 described above, the curing applicator 310 includes a curing stimulus positioning assembly 342 that is fixed in a first, deployed position, rather than being moveable between a first, deployed position and a second, stowed position. In that regard, the curing stimulus positioning assembly 342 includes first and second arms 350 and 354 fixedly secured to and extending from the cap portion 324. However, unlike the arms of the curing applicators 10, 110, and 210 described above, which are substantially linear, the first and second arms 350 and 354 have a bent or obtuse shape.

More specifically, the first and second arms 350 and 354 extend at least partially away from the central longitudinal axis of the cap portion 324 before extending downwardly toward the applicator tip 328. In this manner, the first and second arms 350 and 354 do not interfere with the container on which the cap portion 324 is secured when the curing applicator 310 is not in use. It should be appreciated that the first and second arms 350 and 354 may instead have any other suitable shape to accommodate containers (such as a nail polish bottle) having varying widths and cross-sectional shapes.

With the first and second arms 350 and 354 extending at least partially away from the central longitudinal axis of the cap portion 324, the curing stimulus portion 346 is necessarily positioned a bit further away from the applicator tip 328. To accommodate for this distance between the curing stimulus portion 346 and the applicator tip 328, the curing stimulus assembly 329 (which in an embodiment is a light assembly 330) may include an increased number of curing stimuli, such as LEDs (not labeled). It should be appreciated that any suitable combination of arm contour and curing stimulus arrangement, strength, type, etc., may be used to suit the desired curable formulation.

Figure 8:
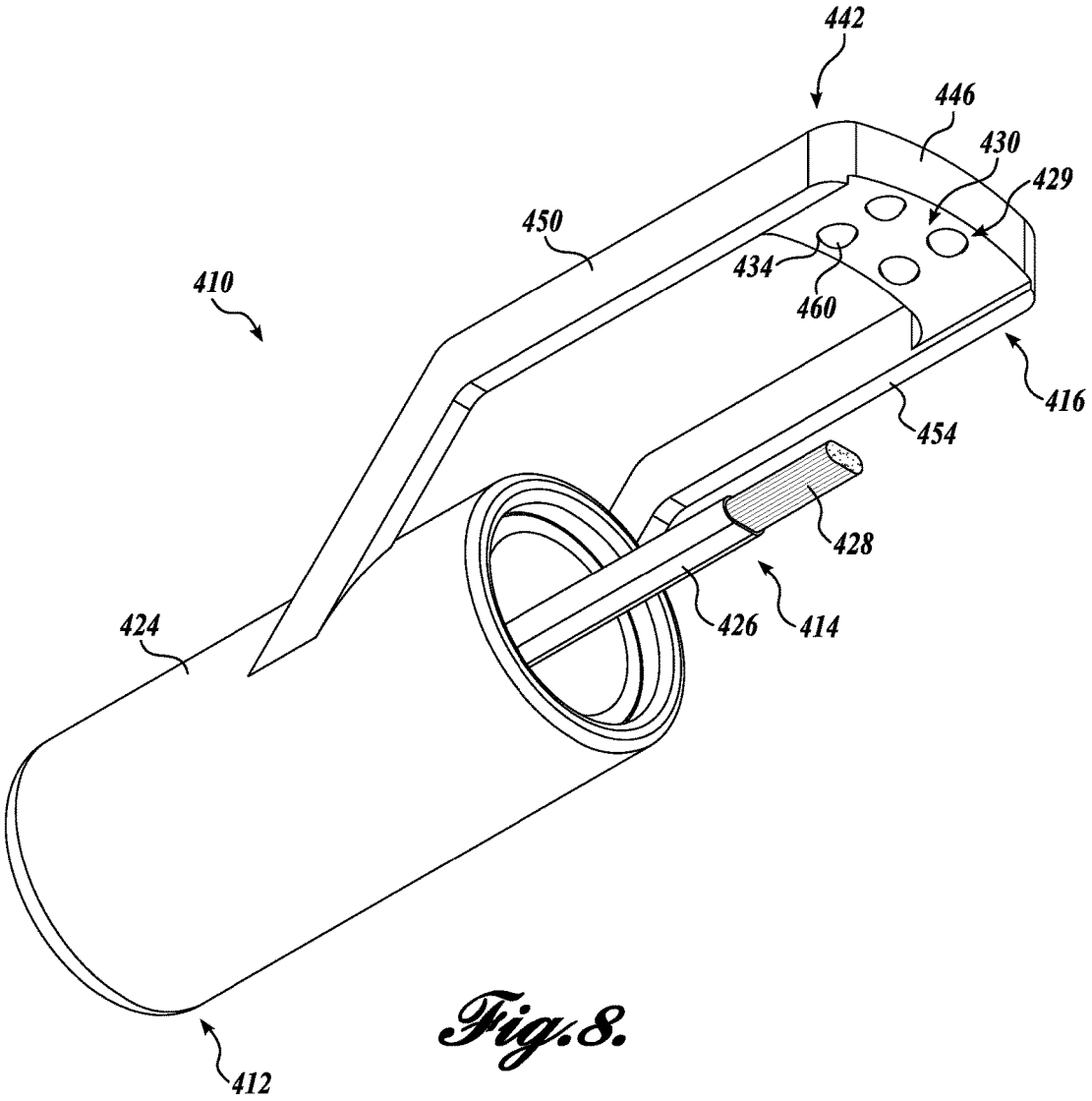
FIG. 8 is bottom isometric view of a fifth exemplary embodiment of a curing applicator formed in accordance with the present disclosure.
Figure 9:
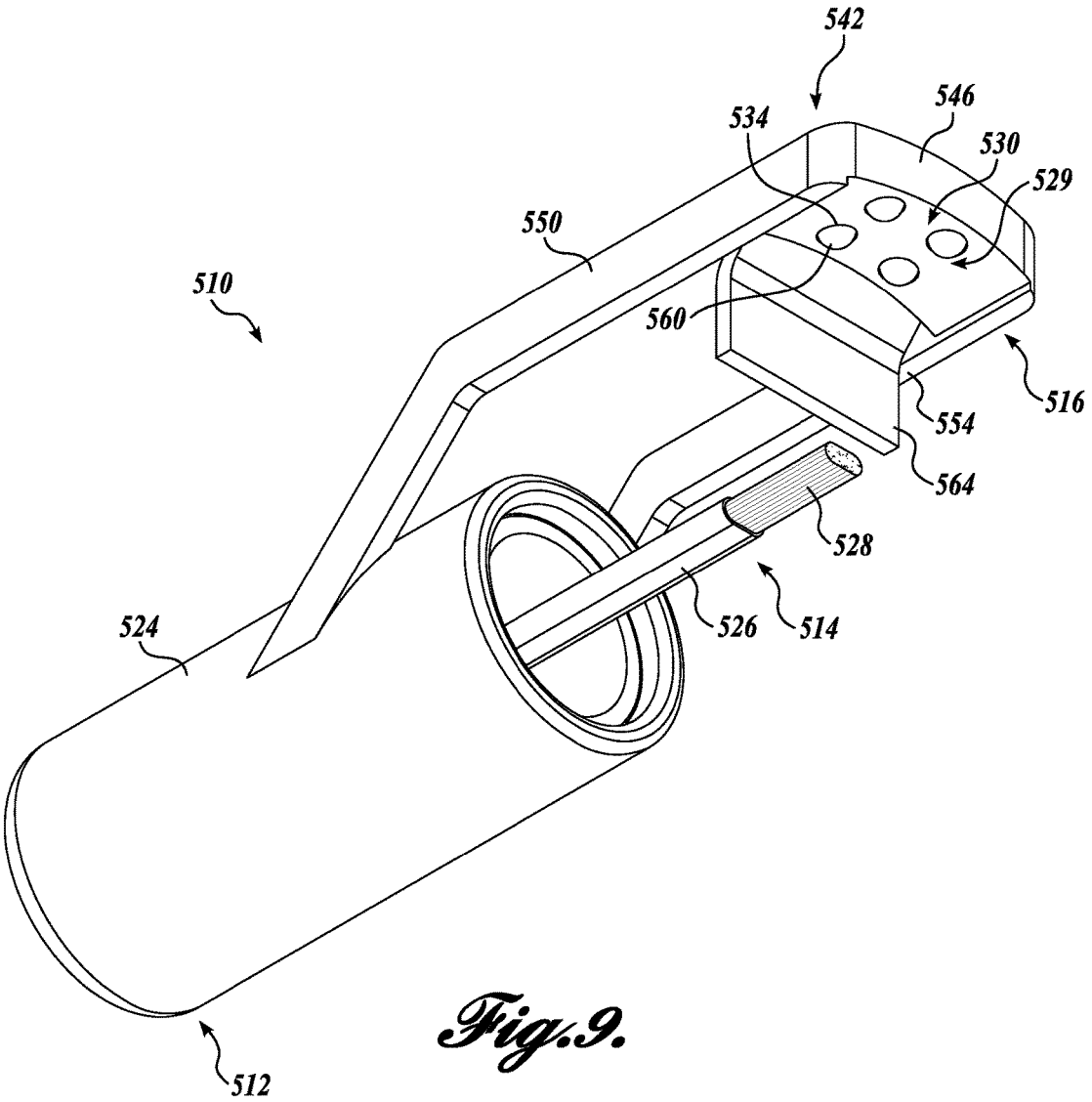
FIG. 9 is bottom isometric view of a sixth exemplary embodiment of a curing applicator formed in accordance with the present disclosure.

Referring to FIGS. 8 and 9, fifth and sixth exemplary embodiments of curing applicators 410 and 510, respectively, are depicted. The curing applicators 410 and 510 are substantially similar to the curing applicator 310 described above with reference to FIGS. 6 and 7. In that regard, for ease of reference, like reference numerals have been used to reference like parts except in the '400 and '500 series, respectively.

The curing applicators 410 and 510 are generally configured to help prevent the curing stimulus from reaching the applicator tip 428 or 529, respectively, during application of the curable formulation to a surface. It can be appreciated that if curable formulation on the applicator tip is exposed to the curing stimulus, the curable formulation may at least partially cure on the applicator tip. By substantially preventing the curing stimulus from reaching the curable formulation on the applicator tip, the curable formulation will not cure until it is applied to a surface.

FIG. 8 depicts a curing applicator 410 having a curing stimulus assembly 429 defined by one or more LEDs 434, wherein each LED 434 may include one or more micro-lenses 460. The micro-lenses 460 are configured to help direct the light or other curing stimulus to curable formulation on the surface (after it is applied with the applicator tip 428). More particularly, the micro-lenses 460 help direct the light or other curing stimulus forwardly of the applicator tip 428. In this manner, the exposure of the remaining curable formulation on the applicator tip 428 to the curing stimulus is minimized. In effect, the micro-lenses 460 help prevent the curable formulation on the applicator tip 428 from curing before being applied to a surface.

Similarly, FIG. 9 depicts a curing applicator 510 substantially identical to the curing applicator 410, except that it further includes a reflector 564, such as a mirror, configured to help direct the light or other curing stimulus to curable formulation on the surface forwardly of the applicator tip 528. In this manner, the exposure of the remaining curable formulation on the applicator tip 528 to the curing stimulus is minimized. Accordingly, the reflector 564 further helps prevent the curable formulation on the applicator tip 528 from curing before being applied to a surface.

The detailed description set forth above in connection with the appended drawings is intended as a description of exemplary embodiments of the curing applicator and are not intended to represent the only embodiments. The representative embodiments described in this disclosure are provided merely as an example or illustration and are not intended to be exhaustive or to limit the claimed subject matter to the precise forms disclosed.

In the foregoing description, numerous specific details are set forth in order to provide a thorough understanding of the exemplary embodiments of the present disclosure. It will be apparent to one skilled in the art, however, that the exemplary embodiments of the present disclosure may be practiced without some or all of the specific details. In some instances, well-known process steps or features have not been described in detail in order not to unnecessarily obscure various aspects of the present disclosure. Further, it will be appreciated that the exemplary embodiments of the present disclosure may employ any combination of features described herein.

The present disclosure may include references to directions, such as "forward," "rearward," "front," "back," "upward," "downward," "lateral," "medial," "in." "out," "extended," "advanced," "retracted," "proximal," "distal," "central," etc. These references, and other similar references in the present disclosure, are only to assist in helping describe and understand the particular embodiment and are not intended to limit the present disclosure to these directions or locations.

The present disclosure may also reference quantities and numbers. Unless specifically stated, such quantities and numbers are not to be considered restrictive, but exemplary of the possible quantities or numbers associated with the present disclosure. Also in this regard, the present disclosure may use the term "plurality" to reference a quantity or number. In this regard, the term "plurality" is meant to be any number that is more than one, for example, two, three, four, five, etc. In an embodiment, "about," "approximately," etc., means plus or minus 5% of the stated value.

Thus, while illustrative embodiments have been illustrated and described, it will be appreciated that various changes can be made therein without departing from the spirit and scope of the invention.

The embodiments of the invention in which an exclusive property or privilege is claimed are defined as follows:

1. A curing applicator for curing a curable formulation as it is applied to a surface, comprising:

an applicator assembly extending from a base assembly, the applicator assembly configured to apply the curable formulation to the surface; and a curing assembly configured to deliver a curing stimulus, the curing assembly extending from the base assembly and positioned to follow the applicator as it applies the curable formulation to the surface;

wherein the curing assembly further includes a curing stimulus positioning assembly for positioning a curing stimulus assembly relative to the applicator such that the curing stimulus assembly may cure the curable formulation as it is applied to the surface, and wherein the curing stimulus positioning assembly is moveable between a first position, wherein the curing stimulus assembly is positioned to follow the applicator as it applies the curable formulation to the surface, and a second position, wherein the curing stimulus assembly is stowed against the base assembly.

2. The curing applicator of claim 1, wherein the applicator assembly includes an elongated stem extending from the base assembly and an applicator tip defined on a distal end of the elongated stem.

3. The curing applicator of claim 2, wherein the curing assembly includes a curing stimulus assembly positioned relative to the applicator tip for following the applicator tip as it applies the curable formulation to the surface.

4. The curing applicator of claim 3, wherein the curing stimulus assembly is defined by a light assembly.

5. The curing applicator of claim 1, wherein the curing assembly is configured to deliver the curing stimulus to the curable formulation on the surface without substantially exposing a curable formulation on the applicator assembly to the curing stimulus.

6. The curing applicator of claim 1, wherein the curing assembly includes one or more micro-lenses configured to direct the curing stimulus to the curable formulation on the surface without substantially exposing a curable formulation on the applicator assembly to the curing stimulus.

7. The curing applicator of claim 1, wherein the curing assembly includes one or more reflectors configured to direct the curing stimulus to the curable formulation on the surface without substantially exposing a curable formulation on the applicator assembly to the curing stimulus.

8. The curing applicator of claim 1, wherein the curing stimulus positioning assembly includes at least one arm extending from the base assembly and a curing stimulus portion disposed on a distal end of the at least one arm, the curing stimulus portion housing the curing stimulus assembly.

9. The curing applicator of claim 8, wherein the at least one arm is pivotally coupled to the base assembly.

10. The curing applicator of claim 8, wherein the at least one arm is slidably coupled to the base assembly.

11. The curing applicator of claim 8, wherein the at least one arm is fixedly coupled to the base assembly.

12. The curing applicator of claim 1, wherein the curing assembly further comprises a filtering element.

13. A curing applicator for curing a curable formulation as it is applied to a surface, the curable formulation contained in a container, the curing applicator comprising:

an applicator assembly extending from a base assembly removably securable to the container, the applicator assembly disposable within the container when the base assembly is secured to the container, the applicator assembly configured to apply the curable formulation to the surface; and a curing assembly configured to deliver a curing stimulus, the curing assembly extending from the base assembly and positioned to follow the applicator as it applies the curable formulation to the surface.

* * * * *